US011326433B2

(12) United States Patent
Asanuma et al.

(10) Patent No.: US 11,326,433 B2
(45) Date of Patent: May 10, 2022

(54) FRACTURING METHOD AND DEPRESSURIZING DEVICE USED FOR SAME

(71) Applicants: NATIONAL INSTITUTE OF ADVANCED INDUSTRIAL SCIENCE AND TECHNOLOGY, Tokyo (JP); THE UNIVERSITY OF TOKYO, Tokyo (JP); TOHOKU UNIVERSITY, Sendai (JP); JMC GEOTHERMAL ENGINEERING CO., LTD., Takizawa (JP); INPEX DRILLING CO., LTD., Tokyo (JP)

(72) Inventors: Hiroshi Asanuma, Koriyama (JP); Shigemi Naganawa, Tokyo (JP); Noriyoshi Tsuchiya, Sendai (JP); Tatsuya Kajiwara, Takizawa (JP); Kuniaki Shimada, Tokyo (JP)

(73) Assignees: NATIONAL INSTITUTE OF ADVANCED INDUSTRIAL SCIENCE AND TECHNOLOGY, Tokyo (JP); THE UNIVERSITY OF TOKYO, Tokyo (JP); TOHOKU UNIVERSITY, Miyagi (JP); JMC GEOTHERMAL ENGINEERING CO., LTD., Iwate (JP); INPEX DRILLING CO., LTD., Tokyo (JP)

( * ) Notice: Subject to any disclaimer, the term of this patent is extended or adjusted under 35 U.S.C. 154(b) by 0 days.

(21) Appl. No.: 16/967,035

(22) PCT Filed: Jan. 31, 2019

(86) PCT No.: PCT/JP2019/003490

§ 371 (c)(1),
(2) Date: Aug. 3, 2020

(87) PCT Pub. No.: WO2019/151443

PCT Pub. Date: Aug. 8, 2019

(65) Prior Publication Data

US 2021/0040831 A1 Feb. 11, 2021

(30) Foreign Application Priority Data

Feb. 5, 2018 (JP) ..... JP2018-018477

(51) Int. Cl.
*E21B 43/26* (2006.01)
*E21B 33/12* (2006.01)
*E21B 34/16* (2006.01)

(52) U.S. Cl.
CPC ..... *E21B 43/26* (2013.01); *E21B 33/12* (2013.01); *E21B 34/16* (2013.01)

(58) Field of Classification Search
CPC ..... E21B 43/26; E21B 33/12; E21B 34/16; E21B 43/00
See application file for complete search history.

(56) References Cited

U.S. PATENT DOCUMENTS 2,384,090 A * 9/1945 Hartsell ..... E21B 34/12 166/99
2,974,922 A * 3/1961 Keithahn ..... F16K 31/52441 251/77

(Continued)

FOREIGN PATENT DOCUMENTS

CA 908044 A 8/1972
JP 2010236179 A 10/2010

(Continued)

OTHER PUBLICATIONS

International Search Report (ISR) (and English translation thereof) dated Apr. 9, 2019 issued in International Application No. PCT/JP2019/003490.

(Continued)

*Primary Examiner* — Steven A MacDonald
(74) *Attorney, Agent, or Firm* — Holtz, Holtz & Volek PC

(57) ABSTRACT

A fracturing method, to cause a crack in bedrock, includes installing a depressurizing device in a well in the bedrock, (Continued)

and depressurizing the inside of the well with the installed depressurizing device. The installing step includes installing, in the well, a connecting pipe, which is connected to the depressurizing device, and a packer, which is attached to the connecting pipe, and the depressurizing step includes shutting off a gap between the well and the connecting pipe, with the packer, and depressurizing a region in the well below the packer, with the depressurizing device.

8 Claims, 12 Drawing Sheets

(56) References Cited

U.S. PATENT DOCUMENTS 3,308,882 A * 3/1967 Lebourg ..... E21B 49/081
73/152.23
5,014,788 A * 5/1991 Puri ..... E21B 43/006
166/305.1
10,487,620 B2 11/2019 Yoshikawa et al.
2004/0016549 A1* 1/2004 Selinger ..... E21B 43/12
166/369
2010/0032171 A1 2/2010 Bali et al.
2013/0228337 A1 9/2013 Dombrowski et al.
2018/0371866 A1 12/2018 Shimada et al.
2020/0048535 A1* 2/2020 Favero ..... E21B 43/16

FOREIGN PATENT DOCUMENTS

JP 2014234794 A 12/2014
JP 2016098503 A 5/2016
JP 2017110367 A 6/2017

OTHER PUBLICATIONS

Written Opinion dated Apr. 9, 2019 issued in International Application No. PCT/JP2019/003490.
Extended European Search Report (EESR) dated Oct. 7, 2021, issued in counterpart European Application No. 1978135.1.

* cited by examiner

[FIG. 1]
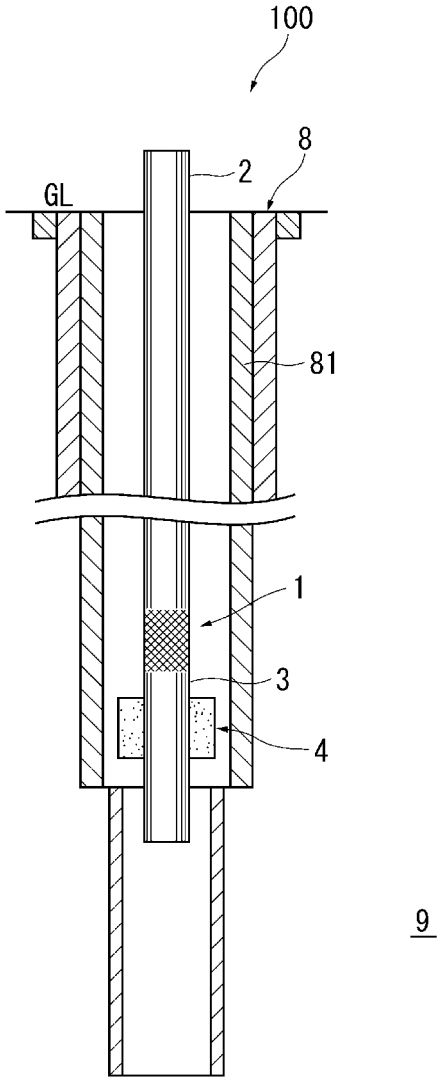

[FIG. 2]
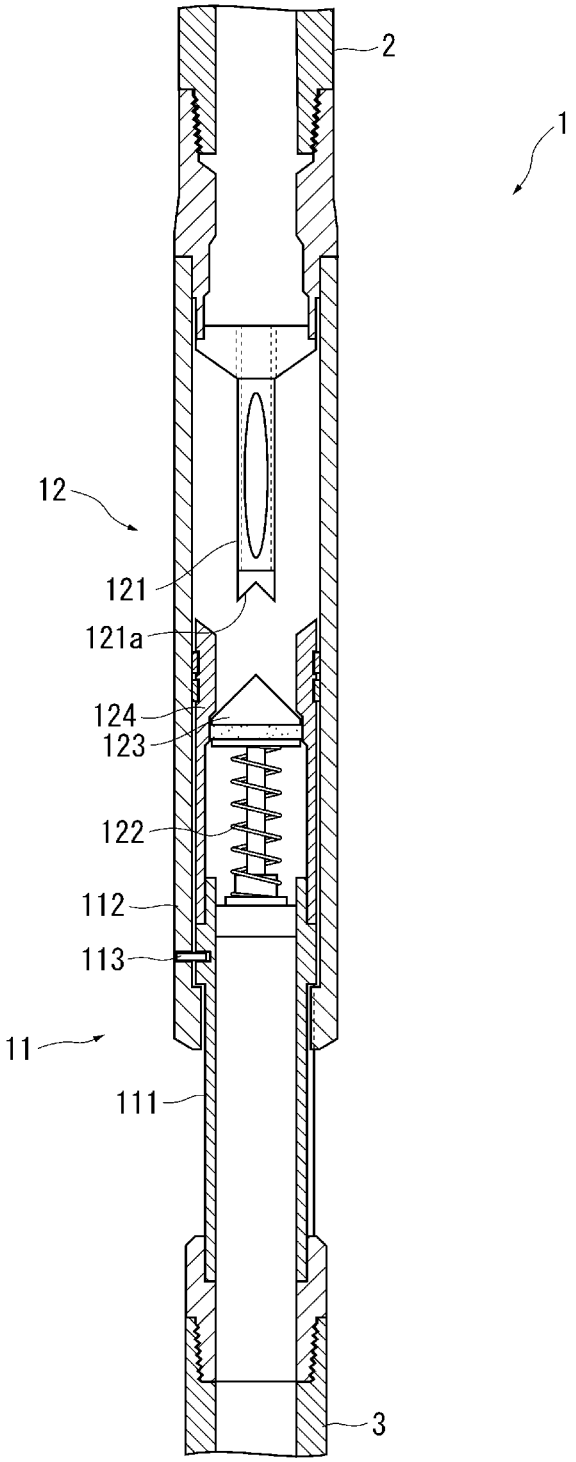

[FIG. 3]
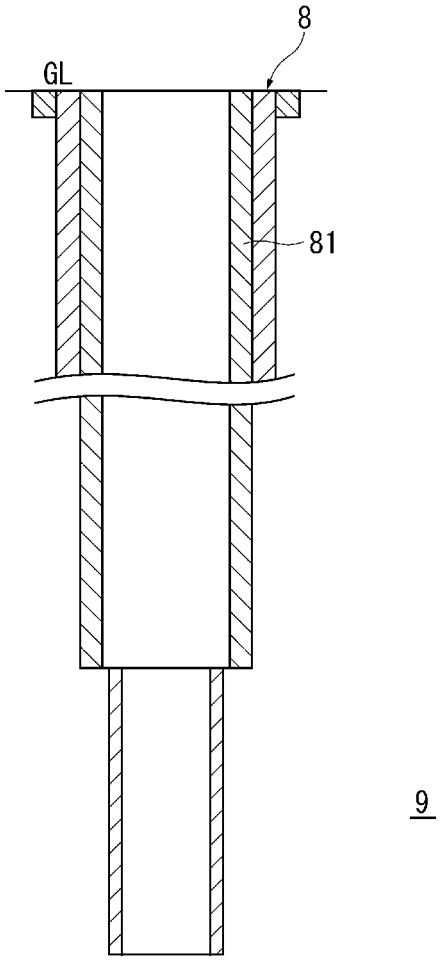

[FIG. 4]
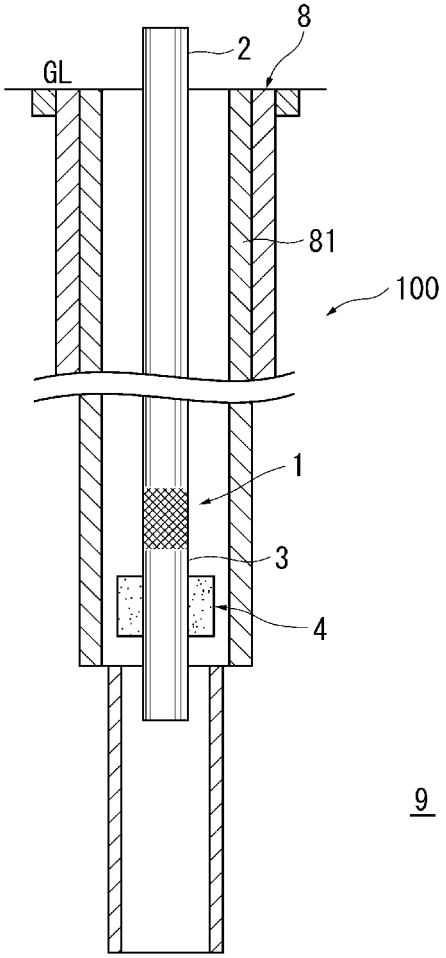

[FIG. 5]
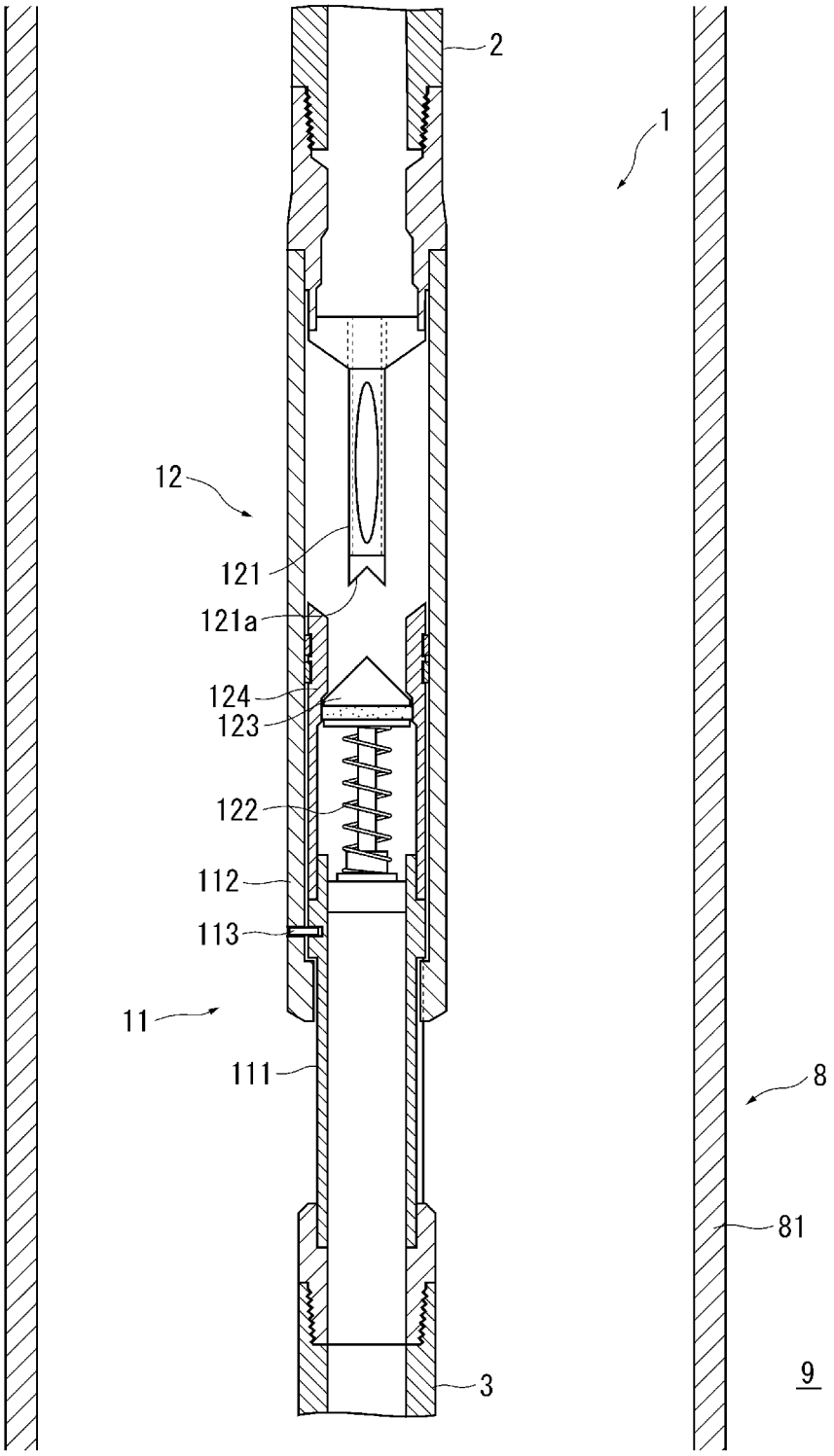

[FIG. 6]
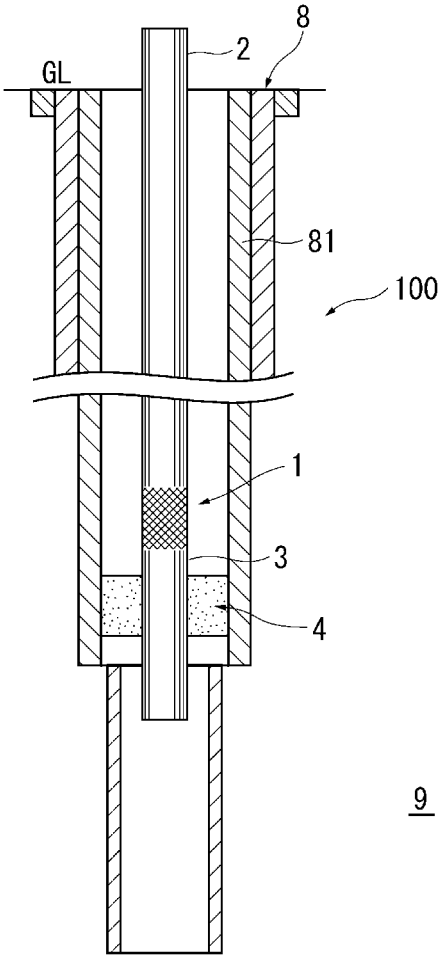

[FIG. 7]
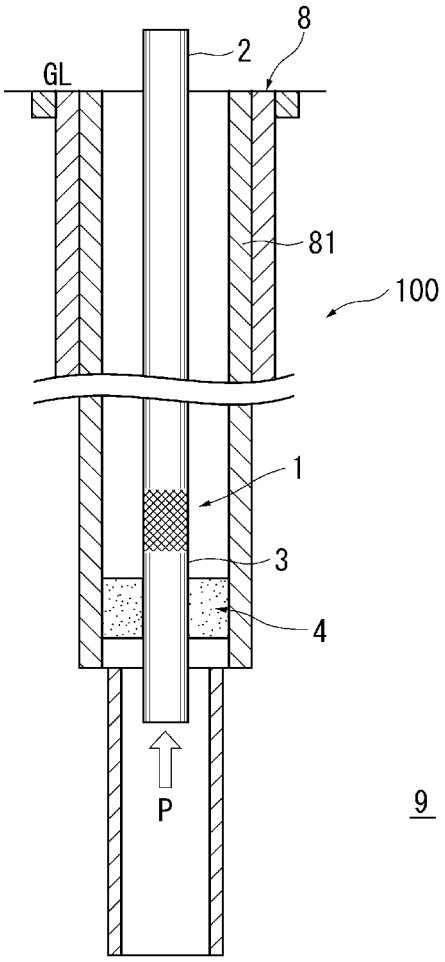

[FIG. 8]
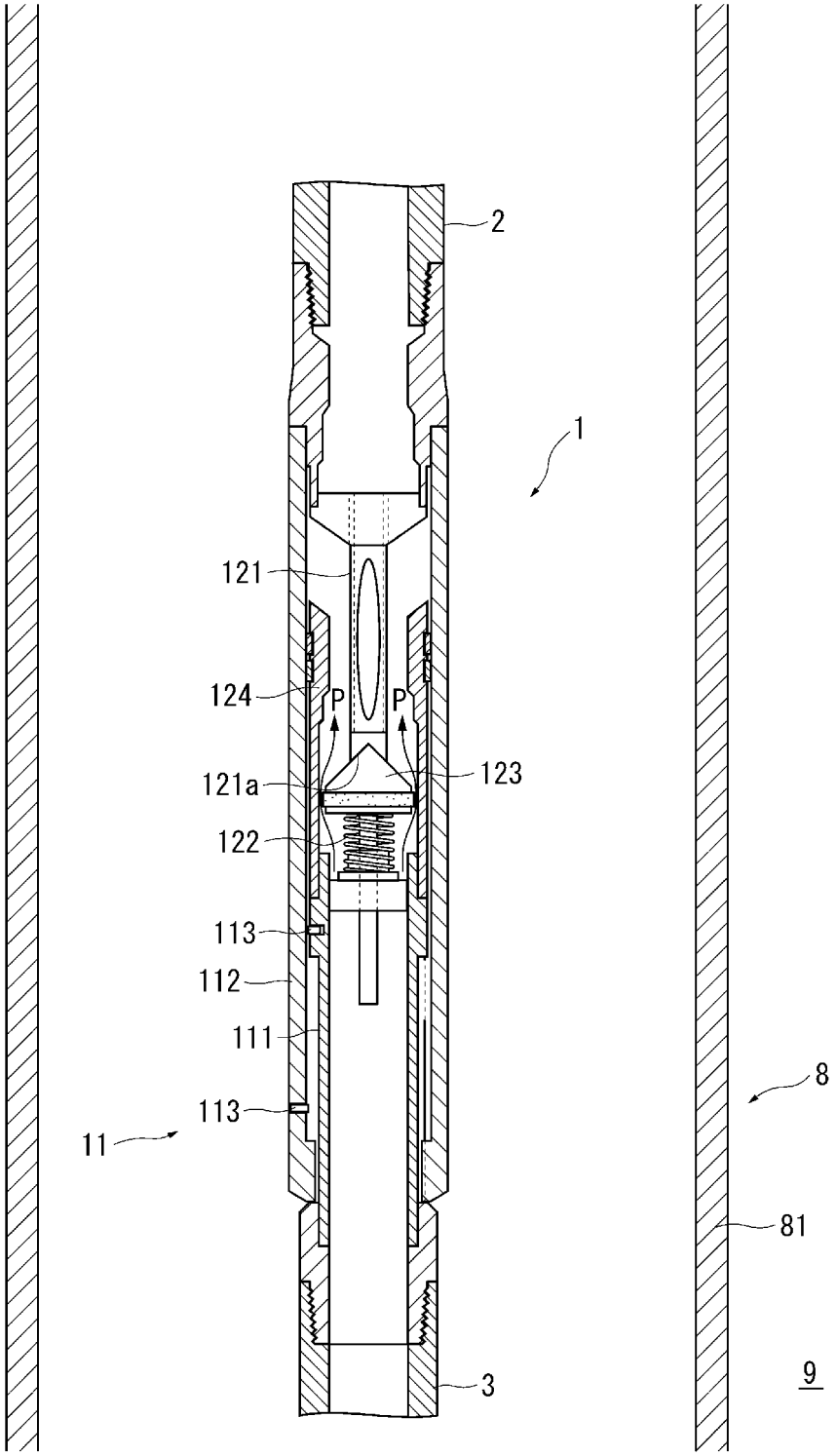

[FIG. 9]
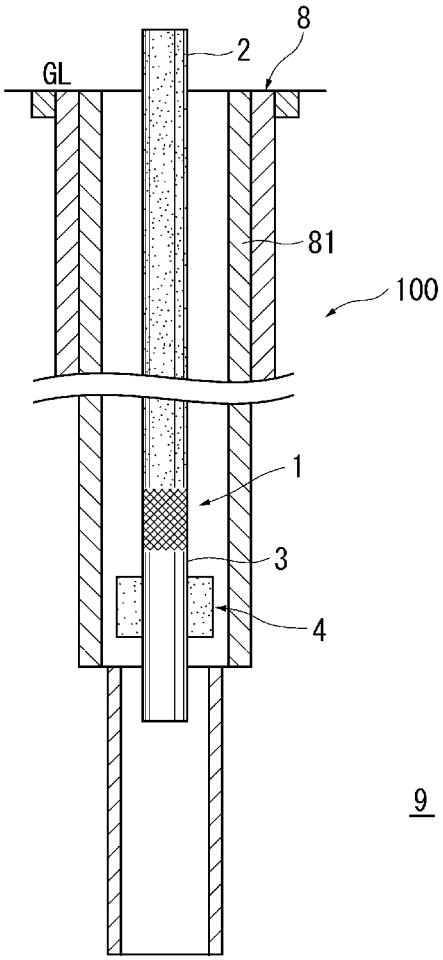

[FIG. 10]
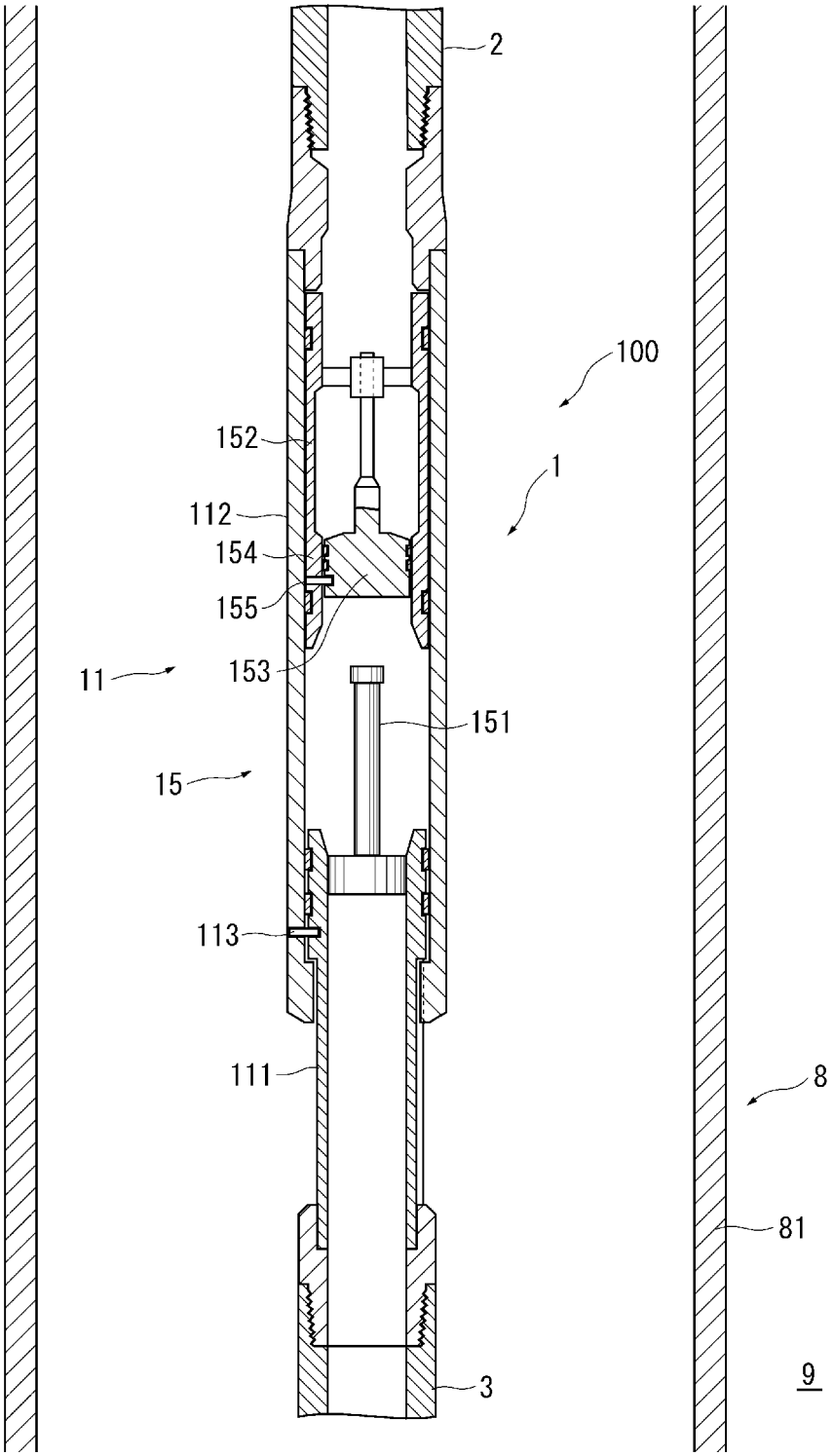

[FIG. 11]
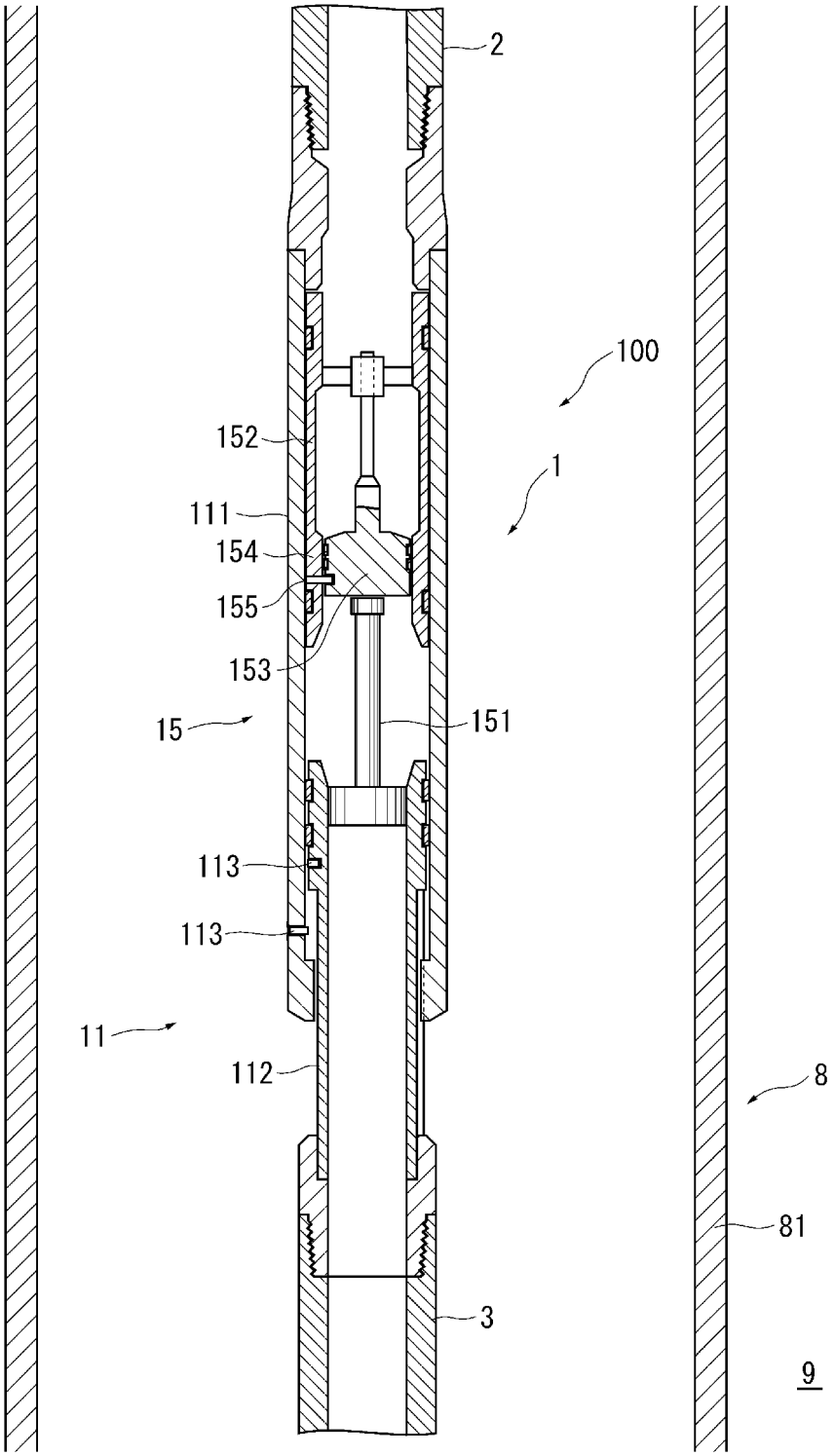

[FIG. 12]
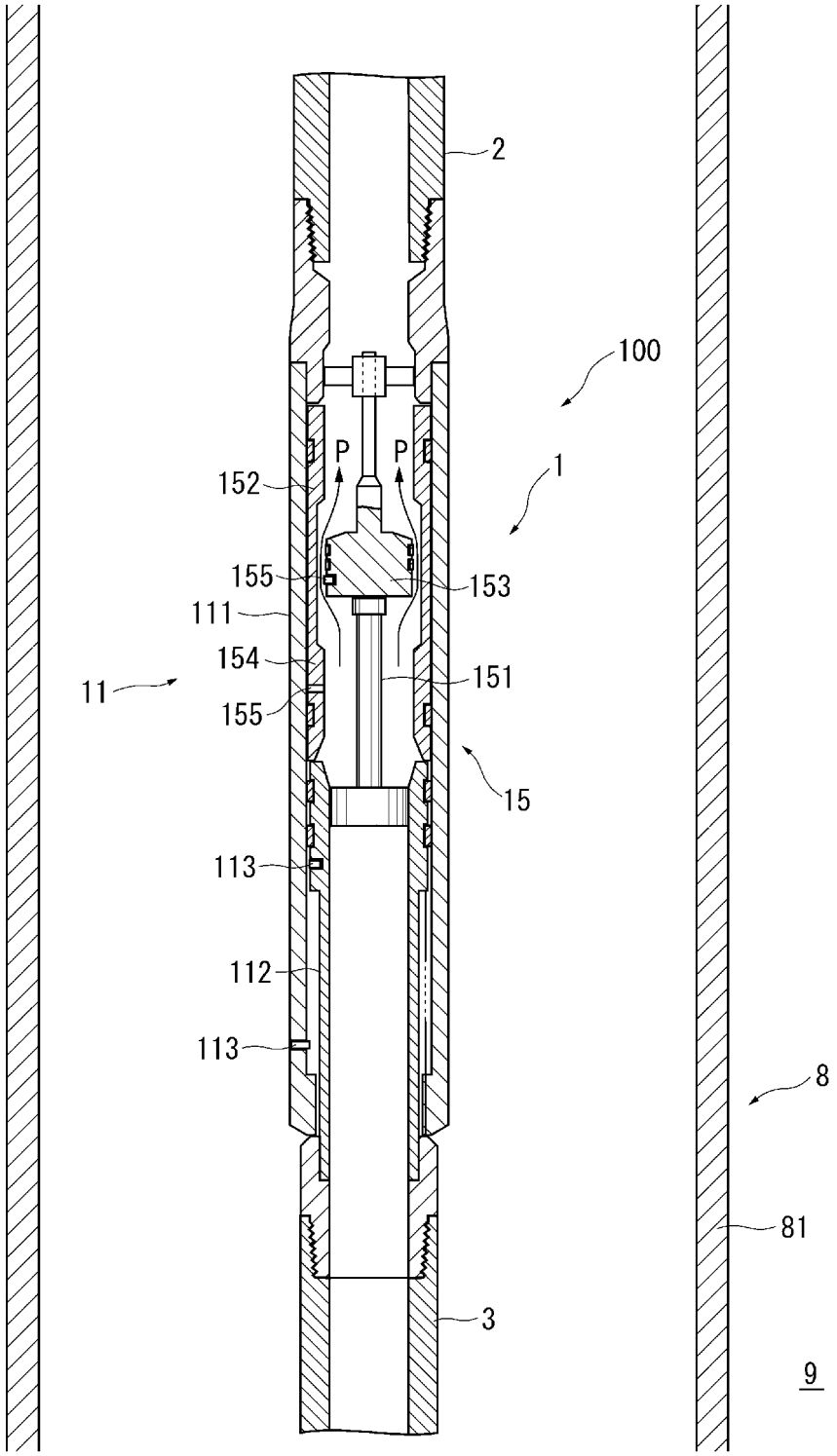

FRACTURING METHOD AND DEPRESSURIZING DEVICE USED FOR SAME

TECHNICAL FIELD

The present invention relates to a fracturing method that is used to fracture bedrock, and a depressurizing device that is used for the same.

BACKGROUND ART

Geothermal power generation uses geofluids to generate electricity. Geofluid regions currently used for power generation are equal to or lower than the critical point of pure water (374° C. and 22 MPa). Envisaging the future, supercritical geothermal power generation to utilize supercritical fluids (fluids at or above the critical point) that are present in places beyond the regions currently used, for geothermal power generation, is under research. The use of supercritical fluids for geothermal power generation provides an advantage of increasing specific enthalpy. For example, the specific enthalpy of the liquid-phase of saturated water vapor pressure (about 4 MPa) at 250° C. is approximately 1000 kJ/kg, and the specific enthalpy of heated steam at 400° C. is approximately 3000 kJ/kg.

Heretofore, a hydraulic fracturing method that is used when collecting underground resources such as oil, natural gas, and shale gas has been known. This hydraulic fracturing method refers to a method of causing cracks in bedrock by injecting a fracturing fluid, such as water filled in a well, in the bedrock at high pressure.

To prevent the resulting cracks from collapsing due to the pressure in the ground and/or the like, a crack support material, referred to as a "proppant," is sometimes added to the fracturing fluid. With the conventional hydraulic fracturing method, a fracturing fluid, in which a granular material such as sand is added as a proppant, is injected at high pressure. Furthermore, in a method of mining underground resources using the hydraulic fracturing method disclosed in Patent Literature 1, a fracturing fluid containing a hydrolysable blocking agent for blocking hydrolysable materials that temporarily seal cracks is injected at high pressure.

According to the conventional hydraulic fracturing method and the mining method disclosed in Patent Literature 1, it is possible to improve the permeability (transparency) of bedrock and collect underground resources effectively, by injecting a fracturing fluid at high pressure to cause cracks in the bedrock.

CITATION LIST

Patent Literature

Patent Literature 1: Japanese Unexamined Patent Application Publication No. 2016-098503

SUMMARY OF INVENTION

Problem to be Solved by the Invention

Now, when a supercritical fluid is used for geothermal power generation, the permeability of bedrock where the supercritical fluid is present is important. The permeability of bedrock decreases significantly with depth.

Also, the brittleness of the crust—that is, the shear strength of bedrock—increases as the depth increases. Such changes in strength follow the so-called law of friction. In other words, up to a certain depth is the brittle range of bedrock, which can be destroyed by applying force to the bedrock. On the other hand, since the temperature also increases with depth, a certain depth and below is the ductile range of bedrock, which can be deformed by applying force to the bedrock.

The above-described conventional hydraulic fracturing method and the method disclosed in Patent Literature 1 inject a fracturing fluid at high pressure, in order to improve the permeability of bedrock, and therefore are applicable to the brittle range of bedrock, which can be destroyed by applying force. That is, even if a fracturing fluid is injected in the ductile range of bedrock where a supercritical fluid is present, it is still not possible to cause cracks in the ductile range of bedrock, and, as a result of this, the permeability of bedrock cannot be improved. Therefore, the conventional hydraulic fracturing method and the mining method disclosed in Patent Literature 1 cannot be applied to the ductile range of bedrock.

Therefore, there is a strong need for a technique for causing cracks in the ductile range of bedrock and utilizing the supercritical fluid that is present in the ductile range of bedrock.

The present invention has been made in view of the above-described problems, and it is therefore an object of the present invention to provide a fracturing method that can cause cracks even in the ductile range of bedrock, and a depressurizing device that is used for this.

Means for Solving the Problems

The fracturing method according to a first invention, which is used to cause a crack in bedrock, includes an installation step of installing, in a well installed in the bedrock, a depressurizing device, which depressurizes the inside of the well, and a depressurization step of depressurizing the inside of the well, with the depressurizing device installed in the installation step.

Based on the first invention, in the fracturing method according to a second invention, the installation step includes installing, in the well, a connecting pipe, which is connected to the depressurizing device, and a packer, which is attached to the connecting pipe, and the depressurization step includes shutting off a gap between the well and the connecting pipe, with the packer, and depressurizing a region in the well below the packer, with the depressurizing device.

Based on the first invention or the second invention, in the fracturing method according to a third invention, the installation step includes installing the depressurizing device including a flow path, in which a fluid travels, and a switching mechanism, which switches between opening and closing the flow path, in the well with the flow path closed, and the depressurization step includes depressurizing the inside of the well by switching the switching mechanism and opening up the flow path that is closed.

Based on the third invention, in the fracturing method according to a fourth invention, the installation step includes installing, in the well, the depressurizing device including the flow path, which includes a first flow path, which is connected to a connecting pipe, to which a packer that shuts off the well is attached, and a second flow path, which is coupled to the first flow path, so as to be able to move in a relative manner, a closing unit, which closes the flow path, and the switching mechanism, which includes a locking unit, which locks the closing unit, and the depressurization step includes depressurizing the inside of the well by moving the first flow path and the second flow path relative to each other, and opening up the flow path closed with the closing unit locked by the locking unit.

Based on any one of the first invention to the fourth invention, in the fracturing method according to a fifth invention, the depressurization step includes depressurizing the inside of the well, installed in the bedrock containing a fluid in a supercritical state or a subcritical state.

The depressurizing device according to a sixth invention is a depressurizing device used in the fracturing method according to any one of the first invention to the fifth invention, and depressurizes the inside of the well.

Based on the sixth invention, the depressurizing device according to a seventh invention includes a flow path, in which a fluid travels, and a switching mechanism, which switches between opening and closing the flow path.

Advantageous Effects of Invention

The fracturing method according to the present invention includes a depressurization step of depressurizing the inside of a well by means of a depressurizing device. By this means, with the fracturing method according to the present invention, a high-temperature and high-pressure fluid in a supercritical state or a subcritical state is depressurized and boiled. Therefore, with the fracturing method according to the present invention, bedrock is cooled quickly by the latent heat of vaporization during the depressurization and boiling, so that it is possible to cause cracks in the bedrock by using the difference in thermal stress between the quickly cooled part and the other parts.

The depressurizing device according to the present invention depressurizes the inside of a well. By this means, with the depressurizing device according to the present invention, a high-temperature and high-pressure fluid in a supercritical state or a subcritical state is depressurized and boiled. Consequently, with the depressurizing device according to the present invention, bedrock is cooled quickly by the latent heat of vaporization during the depressurization and boiling, so that it is possible to cause cracks in the bedrock by using the difference in thermal stress between the quickly cooled part and the other parts.

BRIEF DESCRIPTION OF DRAWINGS

FIG. 1 is a diagram to show a fracturing system that is used in the fracturing method according to the present invention;

FIG. 2 is a diagram to primarily show a first embodiment of the depressurizing device according to the present invention;

FIG. 3 is a diagram to show a well at the beginning of the fracturing method according to the present invention;

FIG. 4 is a diagram to show an installation step in the fracturing method according to the present invention;

FIG. 5 is a diagram to primarily show the depressurizing device according to the first embodiment in the installation step;

FIG. 6 is a diagram to show a fracturing system in which, in the depressurization step, the gap between a well and a connecting pipe is shut off with a packer;

FIG. 7 is a diagram to show a fracturing system when the depressurizing device carries out depressurization in the depressurization step;

FIG. 8 is a diagram to primarily show the depressurizing device of FIG. 7;

FIG. 9 is a diagram to show the fracturing system at the end of the depressurization step;

FIG. 10 is a diagram to primarily show a second embodiment of the depressurizing device according to the present invention;

FIG. 11 is a diagram to primarily show the depressurizing device, in which a first flow path and a second flow path are decoupled in the depressurization step; and FIG. 12 is a diagram to primarily show the depressurizing device in which the fixing unit and the closing unit are decoupled in the depressurization step.

DESCRIPTION OF EMBODIMENTS

Hereinafter, examples for carrying out the fracturing method according to the present invention and a depressurizing device that is used therefor will be described in detail with reference to the drawings.

FIG. 1 is a diagram to show a fracturing system 100 that is used in the fracturing method according to the present invention.

The fracturing system 100 is used for the fracturing method according to the present invention, and used to cause cracks in a bedrock 9 near the bottom of a well 8. The fracturing system 100 is installed inside the well 8. A plurality of casing pipes 81 are installed inside the well 8. The bedrock 9 near the bottom of the well 8 is the ductile range, and contains a high-temperature and high-pressure fluid in a supercritical state or a subcritical state. Also, the fluid contained in the bedrock 9 include, for example, water, carbon dioxide, oil, natural gas, shale gas, and so forth. The length of the well 8 depends on the bedrock 9 to be installed, and is 3 km or more, for example.

The fracturing system 100 includes a depressurizing device 1 according to the present invention, a pipe body 2, a connecting pipe 3, and a packer 4.

The depressurizing device 1 depressurizes the inside of the well 8. The depressurizing device 1 has the pipe body 2 connected to its upper-end side, and has the connecting pipe 3 connected to its lower-end side. Note that the connecting pipe 3 connected with the pipe body 2 may be connected to the upper-end side of the depressurizing device 1.

A number of tubular members such as steel pipes and drill pipes are coupled to the pipe body 2. The pipe body 2 is inserted in the casing pipe 81 of the well 8, and extends from near the ground to near the bottom of the well 8.

The connecting pipe 3 is a tubular member made of metal or the like, around which the packer 4 is attached.

The packer 4 expands by means of a predetermined mechanism, to shut off the gap (annulus part) between the casing pipe 81 of the well 8 and the connecting pipe 3.

For example, a packer 4 made of resin or metal is used. In addition, the packer 4 may be filled with an enclosed liquid such as water inside, and expand by the thermal expansion of the enclosed liquid. The packer 4 filled with the enclosed liquid can be used even if the temperature of the bedrock 9 is 374° C. or higher, which is the critical point of water.

In addition, although the connecting pipe 3 and the packer 4 are arranged on the lower side of the depressurizing device 1 in the example shown in FIG. 1, they may be arranged on the upper side of the depressurizing device 1.

FIG. 2 is a diagram to primarily show the first embodiment of the depressurizing device 1 according to the present invention. The depressurizing device 1 according to the first embodiment has a cylindrical flow path 11, in which a fluid travels, and a switching mechanism 12, which switches between opening and closing the flow path 11.

The flow path 11 has a first tubular flow path 111, which is connected to the connecting pipe 3 side, and a cylindrical second flow path 112, which is connected to the pipe body 2 side. The first flow path 111 is arranged below the second flow path 112, and inserted in the second flow path 112.

The first flow path 111 and the second flow path 112 are coupled with each other via a first coupling unit 113 using a shear pin or the like. By unbinding the first coupling unit 113, the first flow path 111 and the second flow path 112 are decoupled, and the first flow path 111 and the second flow path 112 can move in a relative manner.

The switching mechanism 12 has a rod-shaped contact unit 121, which is fixed to the second flow path 112, an elastic unit 122, which is attached to the first flow path 111, a closing unit 123, which is attached to the upper end of the elastic unit 122 to close the flow path 11, and a locking unit 124, which locks the closing unit 123.

A recessed unit 121*a*, which is recessed in a conical shape or the like, is formed at the lower end of the contact unit 121.

For example, a stretchable elastic member such as a spring is used as the elastic unit 122. The elastic unit 122 is attached to the first flow path 111 so as to be stretchable in the direction in which the first flow path 111 extends.

The locking unit 124 is formed in the first flow path 111 so that the upper-end side of the first flow path 111 is reduced in diameter than the other parts of the first flow path.

The closing unit 123 is locked by the locking unit 124 to close the flow path 11. The closing unit 123 is shaped so that the upper end thereof can mate with the recessed unit 121*a* of the contact unit 121, and is formed, for example, in a conical shape.

Next, a fracturing method according to the present invention using the depressurizing device 1 according to the first embodiment will be described.

FIG. 3 is a diagram to show a well 8 at the beginning of the fracturing method according to the present invention. The fracturing method according to the present invention is first started in a state in which the excavation of the well 8 has been completed. A number of casing pipes 81 are coupled to the well 8. The bedrock 9 near the bottom of the well 8 is the ductile range, and contains a high-temperature and high-pressure fluid in a supercritical state or a subcritical state.

The fracturing method according to the present invention includes an installation step and a depressurization step.

FIG. 4 is a diagram to show the installation step in the fracturing method according to the present invention. FIG. 5 is a diagram to primarily show the depressurizing device 1 according to the first embodiment in the installation step.

As shown in FIG. 4, in the installation step, a fracturing system 100, which includes the depressurizing device 1, a pipe body 2, a connecting pipe 3 and a packer 4, is descended to near the bottom of well 8 and installed in the well 8. The bedrock 9 around the packer 4 installed inside the well 8 contains a high-temperature and high-pressure fluid in a supercritical state or a subcritical state.

As shown in FIG. 5, in the installation step, a flow path 11 of the depressurizing device 1 is installed inside the well 8 while being closed with the closing unit 123. In the installation step, the pressure inside the flow path 11 (first flow path 111) below the closing unit 123 is made higher, by a high-temperature and high-pressure fluid in a supercritical state or a subcritical state, than the pressure inside the flow path 11 (second flow path 112) on the higher side over the closing unit 123.

In addition, in the installation step, the first flow path 111 and the second flow path 112 are coupled with each other via the first coupling unit 113.

Following the installation step, the depressurization step is performed. FIG. 6 is a diagram to show the fracturing system in which the gap between the well 8 and the connecting pipe 3 is shut off with the packer 4 in the depressurization step. In the depressurization step, the packer 4 installed is expanded. In the depressurization step, the expanded packer 4 shuts off the gap between the casing pipe 81 of the well 8 and the connecting pipe 3. That is, in the depressurization step, the packer 4 is expanded to divide the inside of the well 8 into a region above the packer 4 and a region below the packer 4.

FIG. 7 is a diagram to show the fracturing system 100 when the depressurizing device 1 carries out depressurization in the depressurization step. FIG. 8 is a diagram to primarily show the depressurizing device 1 of FIG. 7. After the packer 4 shuts off the gap between the casing pipe 81 of the well 8 and the connecting pipe 3, in the depressurization step, the region inside the well 8 below the packer 4 is depressurized by means of the depressurizing device 1. By this means, the fluid contained in the bedrock 9 flow into the connecting pipe 3 along the direction of arrow P in the drawing.

To be more specific, as shown in FIG. 8, in the depressurization step, the first coupling unit 113, which couples the first flow path 111 and the second flow path 11, is unbound, and the second flow path 112 is moved downward with respect to the first flow path 111. Since the gap between the casing pipe 81 of the well 8 and the connecting pipe 3 is shut off with the packer 4, the position of the connecting pipe 3 is fixed. Therefore, the position of the first flow path 111 that is connected with the connecting pipe 3 is also fixed. Therefore, by applying a downward force to the second flow path 112, it is possible to unbind the first coupling unit 113, and push downward and move the second flow path 112 with respect to the first flow path 111. By moving the second flow path 112 downward, the contact unit 121 of the switching mechanism 12 is brought into contact with the closing unit 123. At this time, the recessed unit 121*a* of the contact unit 121 fits on the upper end of the closing unit 123.

Then, by moving the second flow path 112 further downward with respect to the first flow path 111, the elastic unit 122 is deformed so as to contract via the closing unit 123 that is in contact with the contact unit 121. By this means, the closing unit 123 locked by the locking unit 124 is unlocked, and a gap is created between the closing unit 123 and the first flow path 111. As a result of this, the flow path 11, which has been closed with the closing unit 123, is opened up. In this way, the closed flow path 11 is switched by the switching mechanism 12, and the flow path 11 is opened up.

At this time, the gap between the casing pipe 81 of the well 8 and the connecting pipe 3 is shut off with the packer 4. Consequently, a high-temperature and high-pressure fluid in a supercritical state or a subcritical state travels from the connecting pipe 3, into the pipe body 2, in the flow path 11, along the direction of arrow P in the drawing. When the fluid flows into the flow path 11 and the pipe body 2, the region below the packer 4 is depressurized. In this way, in the depressurization step, the region inside the well 8 below the packer 4 is depressurized by means of the depressurizing device 1.

In the depressurization step, the inside of the well 8 is depressurized by means of the depressurizing device 1, so that the high-temperature and high-pressure fluid contained in the bedrock 9 in a supercritical state or a subcritical state is depressurized and boiled. Consequently, the bedrock 9 is quickly cooled by the latent heat of vaporization during the depressurization and boiling, so that it is possible to cause cracks in the bedrock 9 by using the difference in thermal stress between the quickly cooled part and the other parts.

FIG. 9 is a diagram to show the fracturing system 100 at the end of the depressurization step. As shown in FIG. 9, the fluid that has flown into the flow path 11 also flows into the pipe body 2, and the pipe body 2 is filled with the fluid. After the pipe body 2 is filled with the fluid, the expanded packer 4 is contracted so as to open up the gap between the casing pipe 81 of the well 8 and the connecting pipe 3 that has been shut off. Following this, the depressurizing device 1, the pipe body 2, the connecting pipe 3 and the packer 4 are taken out of the well 8, and the fluid filled in the pipe body 2 is collected.

Then, after the fluid filled in the pipe body 2 is collected, the installation step and the depressurization step are newly carried out. Before carrying out the installation step newly, the first coupling unit 113, which is already unbound, is replaced with a new first coupling unit 113 that is not unbound, and the first flow path 111 and the second flow path 112 are coupled in advance.

The installation step and the depressurization step are carried out a number of times, and the fracturing method according to the present invention is completed.

Next, the functions and effects of the fracturing method according to the present invention will be described.

The fracturing method according to the present invention includes a depressurization step of depressurizing the inside of a well 8 by means of a depressurizing device 1. By this means, with the fracturing method according to the present invention, a high-temperature and high-pressure fluid in a supercritical state or a subcritical state is depressurized and boiled. Therefore, with the fracturing method according to the present invention, bedrock 9 is cooled quickly by the latent heat of vaporization during the depressurization and boiling, so that it is possible to cause cracks in the bedrock 9 by using the difference in thermal stress between the quickly cooled part and the other parts.

With the fracturing method according to the present invention, it is possible to improve the permeability (transparency) of the bedrock 9 by causing cracks in the bedrock 9, and, as a result of this, it is possible to collect the fluid contained in the bedrock 9 effectively.

With the fracturing method according to the present invention, unlike conventional hydraulic fracturing methods, a fracturing fluid is not injected in the bedrock 9 at high pressure. Therefore, no equipment for applying high pressure is required, so that it is possible to reduce the cost. In addition, the fracturing method according to the present invention does not require the fracturing fluid itself. Consequently, it is possible to prevent the surrounding water resources from running out, and reduce the burden on the environment.

With the fracturing method according to the present invention, in the installation step, the depressurizing device 1, in which the flow path 11 is closed, is installed inside the well 8, and, in the depressurization step, the switching mechanism 12 is switched to open up the closed flow path 11, thereby depressurizing the inside of the well 8. By this means, according to the present invention, it is possible to depressurize the inside of the well 8 only by switching the switching mechanism 12 of the depressurizing device 1. That is, the pressure inside the well 8 can be reduced easily.

With the fracturing method according to the present invention, in the installation step, the connecting pipe 3 that is connected to the depressurizing device 1 and the packer 4 that is arranged around the connecting pipe 3 are disposed inside the well 8, and, in the depressurization step, the gap between the well 8 and the connecting pipe 3 is shut off with the packer 4, and the region inside the well 8 below the packer 4 is depressurized by means of the depressurizing device 1. By this means, with the fracturing method according to the present invention, it is possible to prevent the fluid from leaking from the gap between the casing pipe 81 of the well 8 and the connecting pipe 3, which is shut off with the packer 4. Consequently, it is possible to allow the fluid to flow into the connecting pipe 3, reliably, and depressurize the inside of the well 8 effectively.

Furthermore, with the fracturing method according to the present invention, in the depressurization step, the fluid that has flown in from the connecting pipe 3 is allowed to flow into the pipe body 2 via the flow path 11. By this means, with the fracturing method according to the present invention, the fluid can be collected effectively.

Particularly, with the fracturing method according to the present invention, the bedrock 9 near the well 8 that is depressurized in the depressurization step contains a fluid in a supercritical state or a subcritical state. At this time, the fluid has a high specific enthalpy, so that this fluid can be used, suitably, for supercritical geothermal power generation.

Next, the functions and effects of the depressurizing device 1 according to the first embodiment will be described.

The depressurizing device 1 according to the present invention depressurizes the inside of the well 8. By this means, with the depressurizing device 1 according to the present invention, a high-temperature and high-pressure fluid in a supercritical state or a subcritical state is depressurized and boiled. Consequently, with the depressurizing device 1 according to the present invention, bedrock 9 is cooled quickly by the latent heat of vaporization during the depressurization and boiling, so that it is possible to cause cracks in the bedrock 9 by using the difference in thermal stress between the quickly cooled part and the other parts.

The depressurizing device 1 according to the present invention includes a flow path 11, in which the fluid contained in the bedrock 9 travels, and a switching mechanism 12, which switches between opening and closing the flow path 11. By this means, the depressurizing device 1 according to the present invention can depressurize the inside of the well 8, simply by switching the switching mechanism 12. That is, the pressure inside the well 8 can be reduced easily.

With the depressurizing device 1 according to the present invention, the connecting pipe 3, around which the packer 4 is attached, is connected to the flow path 11. By this means, the depressurizing device 1 according to the present invention can prevent the fluid from leaking from the gap between the casing pipe 81 and the connecting pipe 3. Consequently, it is possible to allow the fluid to flow into the connecting pipe 3, reliably, and depressurize the inside of the well 8 effectively.

Furthermore, with the depressurizing device 1 according to the present invention, the connecting pipe 3 and the pipe body 2 are connected to the flow path 11. By this means, with the depressurizing device 1 according to the present invention, the fluid that has flown in from the connecting pipe 3 is allowed to flow into the pipe body 2 via the flow path 11. Consequently, the fluid can be collected effectively.

With the depressurizing device 1 according to the present invention, the flow path 11 has a first flow path 111, which is connected to a connecting pipe 3, and a second flow path 112, which is coupled so as to be able to move relative to the first flow path 111, and the switching mechanism 12 has a closing unit 123, which closes the flow path 11, and a locking unit 124, which locks the closing unit 123, and, by allowing the first flow path 111 and the second flow path 112 to move relatively, the closing unit 123, locked by the locking unit 124, is unlocked, and the flow path 11 is opened up.

By this means, with the depressurizing device 1 according to the present invention, the flow path 11 that is closed can be opened up simply by moving the first flow path 111 and the second flow path 112. Consequently, with the depressurizing device 1 according to the present invention, the inside of the well 8 can be depressurized simply by allowing the first flow path 111 and the second flow path 112 to move relatively. That is, the inside of the well 8 can be depressurized even more easily.

With the depressurizing device 1 according to the present invention, the first flow path 111 and the second flow path 112 are coupled via the first coupling unit 113, and, by unbinding this first coupling unit 113, the first flow path 111 and the second flow path 112 can move in a relative manner. By this means, with the depressurizing device 1 according to the present invention, the inside of the well 8 can be depressurized at any position.

The depressurizing device 1 according to the present invention has a closing unit 123, which is formed in a shape that can mate with the contact unit 121. By this means, with the depressurizing device 1 according to the present invention, the closing unit 123 mates with the contact unit 121 when the closing unit 123 contacts the contact unit 121. Therefore, even if the fluid travels in the flow path 11, the closing unit 123 can be kept in a stable state. As a result of this, it is possible to maintain the state in which the flow path 11 is open.

Next, a second embodiment of the depressurizing device according to the present invention will be described. The same components as those of the depressurizing device according to the first embodiment will be assigned the same reference numerals, and detailed description thereof will be omitted.

FIG. 10 is a diagram to primarily show the second embodiment of the depressurizing device 1 according to the present invention. The depressurizing device 1 according to the second embodiment includes, as shown in FIG. 10, a cylindrical flow path 11, in which the fluid contained in bedrock 9 travels, and a switching mechanism 15 for switching between opening and closing the flow path 11.

The switching mechanism 15 has a contact unit 151 of a rod shape, which is fixed to the first flow path 111, a cylindrical fixing unit 152, which is fixed inside the second flow path 112, a closing unit 153, which closes the flow path 11, and a locking unit 154, which locks the closing unit 153.

The fixing unit 152 and the closing unit 153 are coupled with each other, via the second coupling unit 155 using a shear pin or the like. By unbinding the second coupling unit 155, the fixing unit 152 and the closing unit 153 are decoupled, so that the fixing unit 152 and the closing unit 153 can move in a relative manner. The fixing unit 152 has, on its lower-end side, a locking unit 154, which is formed to have a smaller diameter than the other parts. In the example illustrated, the locking unit 154 and the closing unit 153 formed in the fixing unit 152 are coupled with each other via the second coupling unit 155.

The closing unit 153 is locked by the locking unit 154 to close the flow path 11.

Next, a fracturing method according to the present invention using the depressurizing device 1 according to the second embodiment will be described.

The fracturing method according to the present invention includes an installation step and a depressurization step.

In addition, in the installation step, the first flow path 111 and the second flow path 112 are coupled with each other via the first coupling unit 113. Also, in the installation step, the fixing unit 152 and the closing unit 153 are coupled with each other, via the second coupling unit 155. The rest is the same as in the installation step described above, and therefore the description thereof will be omitted.

Following the installation step, the depressurization step is performed. In the depressurization step, the packer 4 installed is expanded. In the depressurization step, the expanded packer 4 shuts off the gap between the casing pipe 81 of the well 8 and the connecting pipe 3.

After the packer 4 shuts off the gap between the casing pipe 81 of the well 8 and the connecting pipe 3, in the depressurization step, the region inside the well 8 below the packer 4 is depressurized by means of the depressurizing device 1.

FIG. 11 is a diagram to primarily show the depressurizing device 1, in which a first flow path 111 and a second flow path 112 are decoupled in the depressurization step. To be more specific, as shown in FIG. 11, in the depressurization step, the first coupling unit 113, which couples the first flow path 111 and the second flow path 112, is unbound, and the second flow path 112 is moved downward with respect to the first flow path 111. Since the gap between the casing pipe 81 of the well 8 and the connecting pipe 3 is shut off with the packer 4, the position of the connecting pipe 3 is fixed. Therefore, the position of the first flow path 111 that is connected with the connecting pipe 3 is also fixed. Therefore, by applying a downward force to the second flow path 112, it is possible to unbind the first coupling unit 113, and push downward and move the second flow path 112 with respect to the first flow path 111. By moving the second flow path 112 downward, the contact unit 151 of the switching mechanism 15 is brought into contact with the closing unit 153.

FIG. 12 is a diagram to primarily show the depressurizing device 1 in which the fixing unit 152 and the closing unit 153 are decoupled in the depressurization step. As the closing unit 153 of the switching mechanism 15 contacts the contact unit 151, the position of the closing unit 153 is fixed. Consequently, by applying a downward force to the second flow path 112 more, it is possible to unbind the second coupling unit 155, which couples the fixing unit 152 and the closing unit 153 fixed to the second flow path 112, and move the second flow path 112 further downward with respect to the first flow path 111. By moving the second flow path 112 further downward, the closing unit 153, locked by the locking unit 154, is unlocked, and a gap is created between the closing unit 153 and the fixing unit 152. As a result of this, the flow path 11 that is closed with the closing unit 153 is opened up. In this way, the closed flow path 11 is switched by the switching mechanism 15, and the flow path 11 is opened up.

At this time, the gap between the casing pipe 81 of the well 8 and the connecting pipe 3 is shut off with the packer 4. Consequently, a high-temperature and high-pressure fluid in a supercritical state or a subcritical state travels from the connecting pipe 3, into the pipe body 2, in the flow path 11, along the direction of arrow P in the drawing. When the fluid flows into the flow path 11 and the pipe body 2, the region below the packer 4 is depressurized. In this way, in the depressurization step, the region inside the well 8 below the packer 4 is depressurized by means of the depressurizing device 1.

In the depressurization step, the inside of the well 8 is depressurized by means of the depressurizing device 1, so that the high-temperature and high-pressure fluid contained in the bedrock 9 in a supercritical state or a subcritical state is depressurized and boiled. Consequently, the bedrock 9 is quickly cooled by the latent heat of vaporization during the depressurization and boiling, so that it is possible to cause cracks in the bedrock 9 by using the difference in thermal stress between the quickly cooled part and the other parts.

The fluid that has flown into the flow path 11 also flows into the pipe body 2, and the pipe body 2 is filled with the fluid. After the pipe body 2 is filled with the fluid, the expanded packer 4 is contracted so as to open up the gap between the casing pipe 81 of the well 8 and the connecting pipe 3 that has been shut off. Following this, the depressurizing device 1, the pipe body 2, the connecting pipe 3 and the packer 4 are taken out of the well 8, and the fluid filled in the pipe body 2 is collected.

Then, after the fluid filled in the pipe body 2 is collected, the installation step and the depressurization step are newly carried out. Before carrying out the installation step newly, the first coupling unit 113, which is already unbound, is replaced with a new first coupling unit 113 that is not unbound, and the first flow path 111 and the second flow path 112 are coupled in advance. In addition, the second coupling unit 155, which is already unbound, is likewise replaced with a new second coupling unit 155 that is not unbound, and the fixing unit 152 and the closing unit 153 are coupled with each other in advance.

The installation step and the depressurization step are carried out a number of times, and the fracturing method according to the present invention is completed.

Next, the functions and effects of the depressurizing device 1 according to the second embodiment will be described.

The depressurizing device 1 according to the second embodiment, similar to the depressurizing device 1 according to the first embodiment described above, depressurizes the inside of the well 8. By this means, with the depressurizing device 1 according to the present invention, a high-temperature and high-pressure fluid in a supercritical state or a subcritical state is depressurized and boiled. Consequently, with the depressurizing device 1 according to the present invention, bedrock 9 is cooled quickly by the latent heat of vaporization during the depressurization and boiling, so that it is possible to cause cracks in the bedrock 9 by using the difference in thermal stress between the quickly cooled part and the other parts.

The depressurizing device 1 according to the present invention includes a flow path 11, in which the fluid contained in the bedrock 9 travels, and a switching mechanism 15, which switches between opening and closing the flow path 11. By this means, the depressurizing device 1 according to the present invention can depressurize the fluid that is contained in the bedrock 9, simply by switching the switching mechanism 12. That is, the pressure inside the well 8 can be reduced easily.

With the depressurizing device 1 according to the present invention, the flow path 11 has a first flow path 111, which is connected to a connecting pipe 3, and a second flow path 112, which is coupled so as to be able to move relative to the first flow path 111, and the switching mechanism 15 has a closing unit 153, which closes the flow path 11, and a locking unit 154, which locks the closing unit 153, and, by allowing the first flow path 111 and the second flow path 112 to move relatively, the closing unit 123, locked by the locking unit 154, is unlocked, and the flow path 11 is opened up.

By this means, with the depressurizing device 1 according to the present invention, the flow path 11 that is closed can be opened up simply by moving the first flow path 111 and the second flow path 112. Consequently, with the depressurizing device 1 according to the present invention, the inside of the well 8 can be depressurized simply by allowing the first flow path 111 and the second flow path 112 to move relatively. That is, the inside of the well 8 can be depressurized even more easily.

Now, although examples of embodiments of the present invention have been described in detail above, each embodiment described above has simply illustrated a specific example of carrying out the present invention, and these should not be construed as limiting the technical scope of the present invention.

REFERENCE SIGNS LIST

100: fracturing system
1: depressurizing device
11: flow path
111: first flow path
112: second flow path
113: first coupling unit
12: switching mechanism
121: contact unit
121*a*: recessed unit
122: elastic unit
123: closing unit
124: locking unit
15: switching mechanism
151: contact unit
152: fixing unit
153: closing unit
154: locking unit
155: second coupling unit
2: pipe body
3: connecting pipe
4: packer
8: well
81: casing pipe
9: bedrock

The invention claimed is:

1. A fracturing method, which is used to cause a crack in bedrock, the fracturing method comprising:

installing a depressurizing device in a well installed in the bedrock, the bedrock containing a fluid in a supercritical or a subcritical state; and depressurizing an inside of the well with the installed depressurizing device such that the fluid contained in the bedrock is depressurized and boiled.

2. The fracturing method according to claim 1, wherein the installing comprises installing, in the well, a connecting pipe, which is connected to the depressurizing device, and a packer, which is attached to the connecting pipe, and wherein the depressurizing comprises shutting off a gap between the well and the connecting pipe, with the packer, and depressurizing a region in the well below the packer, with the depressurizing device.

3. The fracturing method according to claim 2, wherein the depressurizing device comprises:

a flow path through which the fluid travels, the flow path having a first flow path connected to the connecting pipe to which the packer for shutting off the well is attached and a second flow path coupled to the first flow path such that the first flow path and the second flow path are movable relative to each other; and a switching mechanism which comprises a closing unit for closing the flow path and a locking unit for locking the closing unit and which switches between opening and closing the flow path, wherein the installing comprises installing the depressurizing device in the well with the flow path closed, and wherein the depressurizing comprises depressurizing the inside of the well by moving the first flow path and the second flow path relative to each other to fit a recessed unit provided in a lower end of a rod-shaped contact unit fixed to the second flow path onto an upper end of the closing unit, and opening the flow path closed with the closing unit locked by the locking unit.

4. The fracturing method according to claim 2, wherein the depressurizing device comprises:

a flow path through which the fluid travels, the flow path having a first flow path connected to the connecting pipe to which the packer for shutting off the well is attached and a second flow path coupled to the first flow path such that the first flow path and the second flow path are movable relative to each other;

a switching mechanism which comprises a closing unit for closing the flow path and a locking unit for locking the closing unit and which switches between opening and closing the flow path;

a first coupling unit that couples the first flow path and the second flow path to each other; and a second coupling unit that couples the second flow path and the closing unit to each other, and wherein the depressurizing comprises depressurizing the inside of the well by unbinding the first coupling unit and the second coupling unit to move the first flow path and the second flow path relative to each other, and opening the flow path closed with the closing unit locked by the locking unit.

5. The fracturing method according to claim 1, wherein the depressurizing device comprises:

a flow path through which the fluid travels, the flow path having a first flow path connected to a connecting pipe to which a packer for shutting off the well is attached and a second flow path coupled to the first flow path such that the first flow path and the second flow path are movable relative to each other; and a switching mechanism which comprises a closing unit for closing the flow path and a locking unit for locking the closing unit and which switches between opening and closing the flow path, wherein the installing comprises installing the depressurizing device in the well with the flow path closed, and wherein the depressurizing comprises depressurizing the inside of the well by moving the first flow path and the second flow path relative to each other to fit a recessed unit provided in a lower end of a rod-shaped contact unit fixed to the second flow path onto an upper end of the closing unit, and opening the flow path closed with the closing unit locked by the locking unit.

6. The fracturing method according to claim 1, wherein the depressurizing device comprises:

a flow path through which the fluid travels, the flow path having a first flow path connected to a connecting pipe to which a packer for shutting off the well is attached and a second flow path coupled to the first flow path such that the first flow path and the second flow path are movable relative to each other;

a switching mechanism which comprises a closing unit for closing the flow and a locking unit for locking the closing unit and which switches between opening and closing the flow path;

a first coupling unit that couples the first flow path and the second flow path to each other; and a second coupling unit that couples the second flow path and the closing unit to each other, and wherein the depressurizing comprises depressurizing the inside of the well by unbinding the first coupling unit and the second coupling unit to move the first flow path and the second flow path relative to each other, and opening the flow path closed with the closing unit locked by the locking unit.

7. A depressurizing device, configured to be installed in a well installed in bedrock and to depressurize an inside of the well, the depressurizing device comprising:

a flow path configured to have a fluid travel therein; and a switching mechanism, which switches between opening and closing the flow path, wherein:

the depressurizing device is configured to perform depressurization such that a fluid contained in the bedrock in a supercritical or a subcritical state is depressurized and boiled, the flow path has a first flow path connected to a connecting pipe to which a packer for shutting off the well is attached and a second flow path coupled to the first flow path such that the first flow path and the second flow path are movable relative to each other, the switching mechanism comprises a closing unit for closing the flow path and a locking unit for locking the closing unit, and an upper end of the closing unit is fitted into a recessed unit provided in a lower end of a rod-shaped contact unit fixed to the second flow path.

8. A depressurizing device, configured to be installed in a well installed in bedrock and to depressurize an inside of the well, the depressurizing device comprising:

a flow path configured to have a fluid travel therein; and a switching mechanism, which switches between opening and closing the flow path, wherein:

the depressurizing device is configured to perform depressurization such that a fluid contained in the bedrock in a supercritical or a subcritical state is depressurized and boiled, the flow path has a first flow path connected to a connecting pipe to which a packer for shutting off the well is attached and a second flow path coupled to the first flow path such that the first flow path and the second flow path are movable relative to each other, the switching mechanism comprises a closing unit for closing the flow path and a locking unit for locking the closing unit, the depressurizing device further comprises a first coupling unit that couples the first flow path and the second flow path to each other and a second coupling unit that couples the second flow path and the closing unit to each other, and the first flow path and the second flow path are movable relative to each other by unbinding the first coupling unit and the second coupling unit.

* * * * *